United States Patent [19]

Gäth

[11] 3,937,452

[45] Feb. 10, 1976

[54] METHOD AND APPARATUS FOR MANUFACTURING CONTINUOUS FORM SETS

[76] Inventor: Karl Heinz Gäth, Weinbergstrasse 35, O-3221 Rollinghausen, Germany

[22] Filed: Nov. 26, 1973

[21] Appl. No.: 418,934

[30] Foreign Application Priority Data

Nov. 29, 1972 Germany ..... 2258431

[52] U.S. Cl. ..... 270/39; 270/52; 270/53

[51] Int. Cl.[2] ..... B41L 1/32

[58] Field of Search ..... 270/7, 9, 11, 37, 39, 40, 270/43, 44–45, 51, 52, 52.5, 53, 58; 83/278, 83/423; 278/11.5 A; 156/517, 519, 552, 559, 156/DIG. 2, DIG. 3, DIG. 19

[56] References Cited

UNITED STATES PATENTS

| | | | |
|---|---|---|---|
| 2,178,103 | 10/1939 | Johnson | 282/11.5 A |
| 2,217,507 | 10/1940 | Bottle | 282/11.5 A |
| 2,228,419 | 1/1941 | Stern | 270/39 |
| 2,685,802 | 8/1954 | Ricards | 270/11 |
| 3,416,787 | 12/1968 | Stephens | 83/278 |
| 3,572,682 | 3/1971 | Leach | 270/52 |
| 3,586,593 | 6/1971 | Dahl | 156/519 |

*Primary Examiner*—Robert W. Michell
*Assistant Examiner*—A. Heinz
*Attorney, Agent, or Firm*—Bacon & Thomas

[57] ABSTRACT

Method and apparatus for forming continuous form sets comprising one or more individual form sheets joined to linearly attached bottom sheets in overlying relationship, the bottom sheets being processed from a continuous web supply and advanced sequentially through a processor with intermittent, unidirectional motion, the individual form sheets being secured to each bottom sheet in synchronism with the bottom sheet motion in aligned, overlying relationship at one or more form set assembly stations, the assembled form sets being folded and collected synchronously with the processing and assembly operations. Individual stock material supplies in the form of continuous length rolls or otherwise are provided in association with each assembly station, there being a stock supply for each individual form sheet in each form set, each form sheet of each set being cut from its own supply and accelerated towards its respective assembly station to enable the intermittent joining of individual form sheets to the bottom sheets while the stock supply is continuously and uninterruptedly fed to the sheet cutter. Suitable perforating, printing, glue line applying, indexing and advancing means are provided.

12 Claims, 6 Drawing Figures

FIG. 1
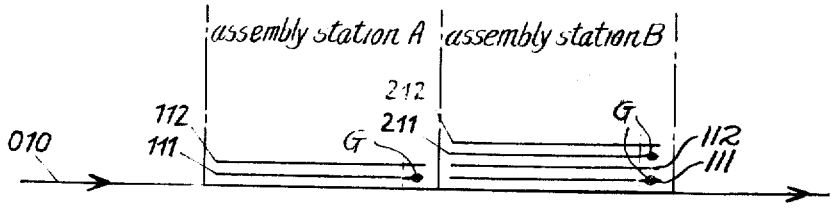
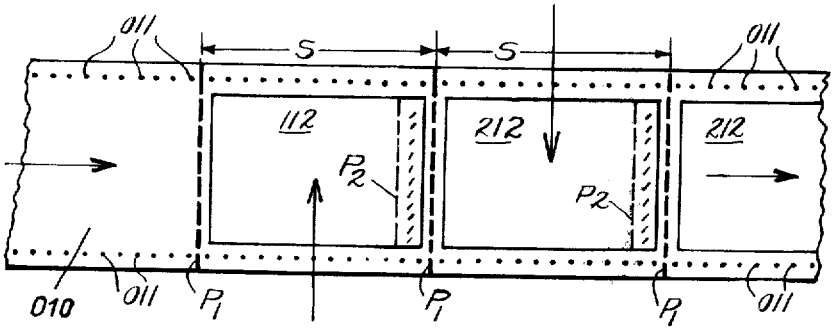
FIG. 2
FIG. 3
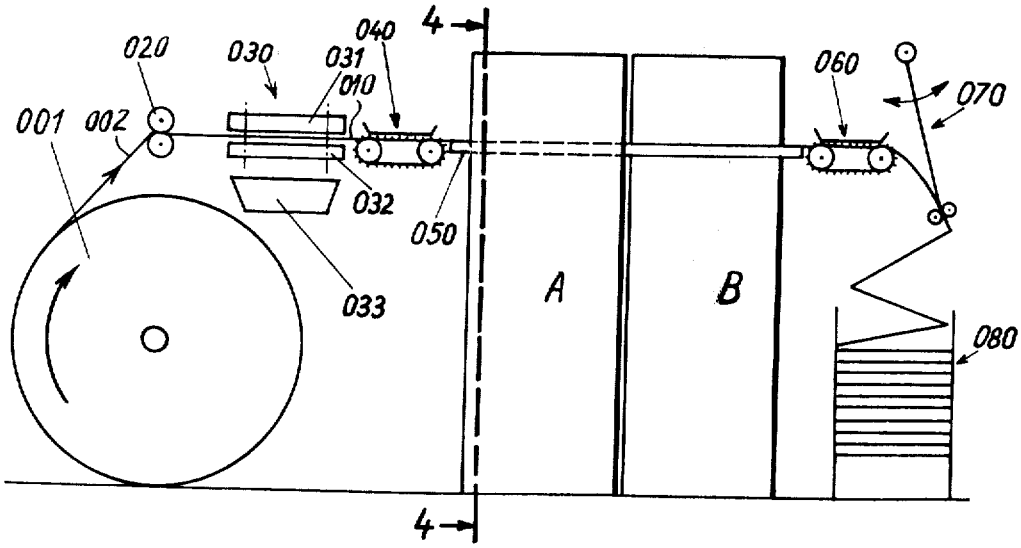

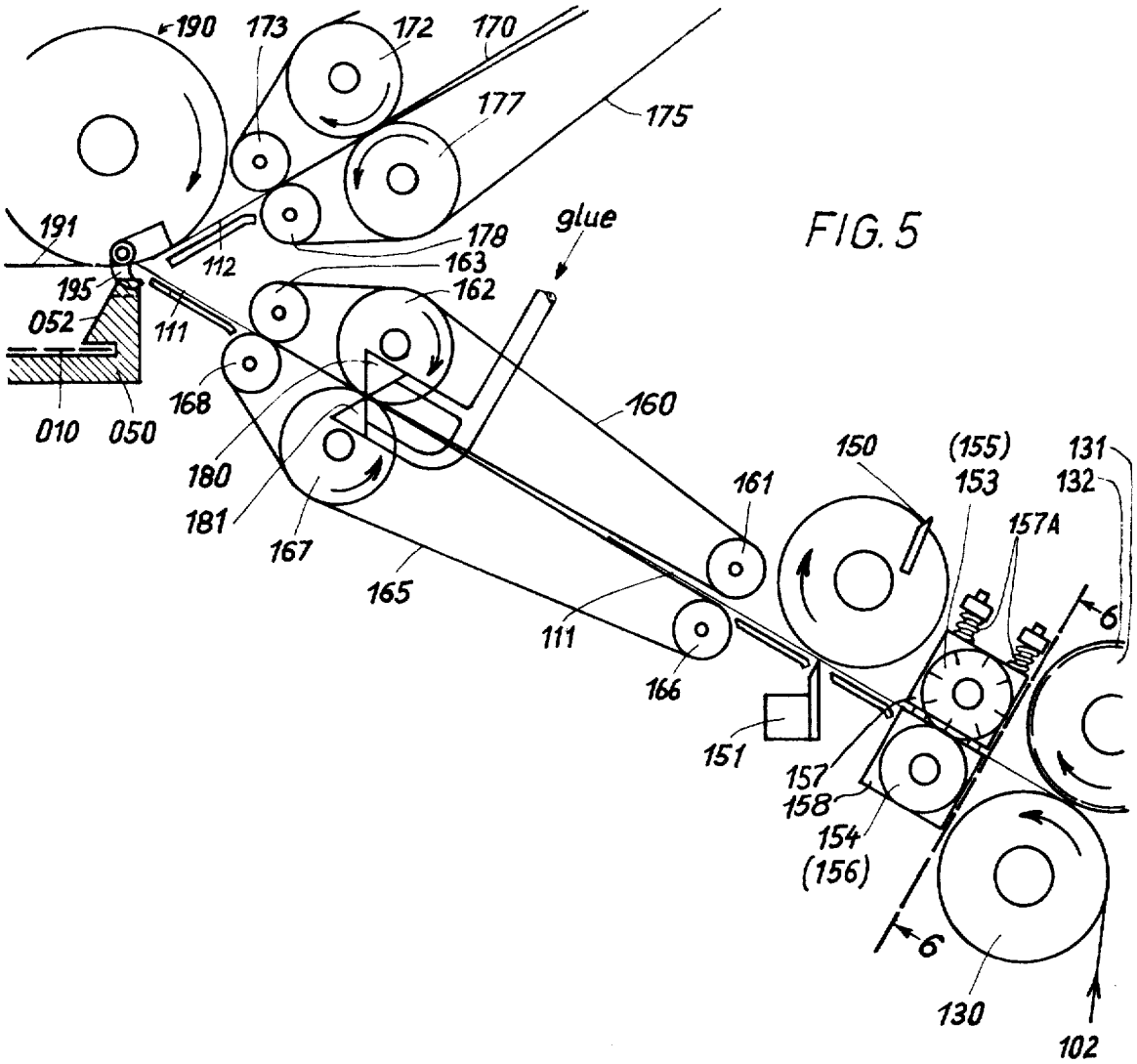
FIG. 5
FIG. 6
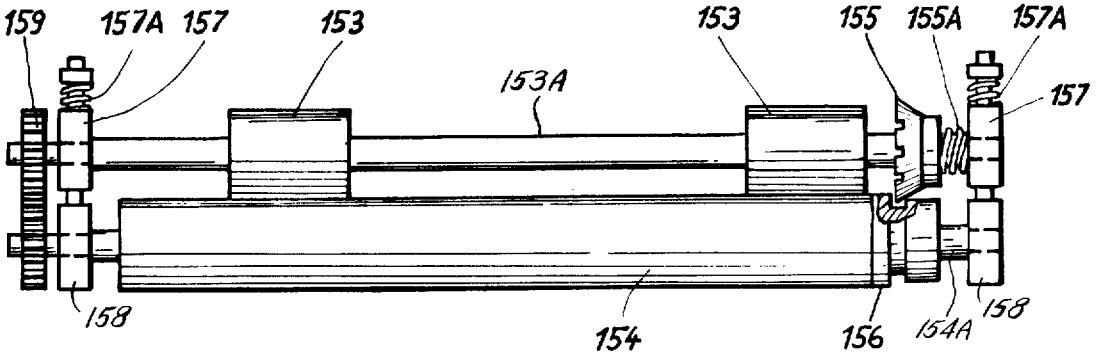

METHOD AND APPARATUS FOR MANUFACTURING CONTINUOUS FORM SETS

BACKGROUND OF THE INVENTION

Manufacturing of continuous form sets, also called "chain-sets" or "snap-band sets" is usually carried out in four separate operation stages, namely:

1. printing and processing of individual form sheets;
2. compiling and gluing the individual form sheets to obtain individual form sets;
3. processing a continuous bottom form sheet, involving usually printing and perforating the bottom sheet to provide indexing/advancing holes and fold/tear lines; and
4. assembling and gluing up the prepared individual form sets along the continuous bottom form sheets in a longitudinally spaced manner.

Each operation stage utilizes one special machine and one or more operators. The plurality of machines consumes much space, as does the need for storage of intermediate products. The efficiency of the above recited process usually will be less than one fourth of the average efficiency of one of the machines used in such a process, since a great deal of time is consumed in loading and unloading the intermediate products between the machines.

SUMMARY OF THE INVENTION

The present invention has as its objective overcoming the disadvantages associated with the known prior art process for making continuous form sets. The invention comprises a process and apparatus for continuously carrying out in one system the manufacture of continuous form sets which comprise one or more individual form sheets secured to linearly attached bottom sheets in overlying relationship, the bottom sheets being processed from a continuous web supply and advanced through the processor with intermittent unidirectional motion. The continuous bottom sheets may be processed in any desired manner including printing and perforating. The individual form sheets are themselves processed and advanced to one or more form set assembly stations where they are aligned in registry with each bottom sheet and joined thereto and to each other in overlying relationship.

The individual form sheets themselves are preferably processed from individual roll stock supplies, a supply being provided for each individual form sheet in a set, the processing operation including selectively printing, perforating, cutting to size and applying glue lines to desired individual sheets as they are fed to their respective assembly stations. For example, two assembly stations may process a pair of individual form sheets from their individual stock supplies, whereby a form set comprising four individual form sheets and a respective bottom sheet is obtained. If the form sets are made up from writing paper and carbon paper stock, the individual form sheet next adjacent the bottom sheet is carbon stock and has applied thereto along opposite surfaces thereof a glue line for enabling its being secured to the bottom sheet and for securing the next above individual form sheet to the form set assembly. Glue lines are provided on carbon sheets at each assembly station whereby the individual form sheets are secured to the bottom sheet and to each other throughout the form set assembly. Of course, if "carbonless" transfer sheets are used, then a glue line would only need to be provided on opposite surfaces of the individual form sheet next adjacent the bottom sheet and alternate form sheets thereabove to obtain the assembled, joined form sets.

The individual form sheets are advanced to each assembly station in synchronism with the intermittent advancing motion of the joined, bottom form sheets whereby the individual form sheets are attached to their respective bottom form sheet while the latter is at rest in the respective assembly station.

The invention further contemplates a system whereby the individual roll stock supplies which ultimately become the individual form sheets in the assembled form sets are continuously fed uninterruptedly to a cutter means which cuts individual form sheets to size from their respective stock supply and an accelerating means for advancing the cut sheets towards their respective assembly stations whereby they may be intermittently joined to their respective bottom sheets without requiring interruption of the continuous feed motion of the individual stock supplies to the cutting means. Moreover, as suggested above, a preliminary assembly of pairs of individual form sheets may be carried out in advance of their being fed to their respective assembly stations whereby two or more individual form sheets may be advanced in overlying, aligned relationship to their respective assembly station for joining with a bottom sheet.

The invention further contemplates the placement of the individual sheet processing and advancing means towards either side of the assembly line along which the joined bottom sheet are advanced. This results in great economy of space since the assembly stations may then be located closely together along the assembly line without crowding the individual form sheet processing apparatus.

DESCRIPTION OF THE PREFERRED EMBODIMENT

Description of the Drawings

FIG. 1 is a schematic elevational view of continuous form sets being assembled;

FIG. 2 is a plan view of FIG. 1;

FIG. 3 is a schematic elevation view of the apparatus of this invention used to produce the continuous form sets;

FIG. 5 is a fragmentary view showing the individual form sheets processing and advancing means shown in FIG. 4 in an enlarged scale; and FIG. 6 is a view taken along line 6—6 of FIG. 5.

DETAILED DESCRIPTION OF THE PREFERRED EMBODIMENT

Figure 4:
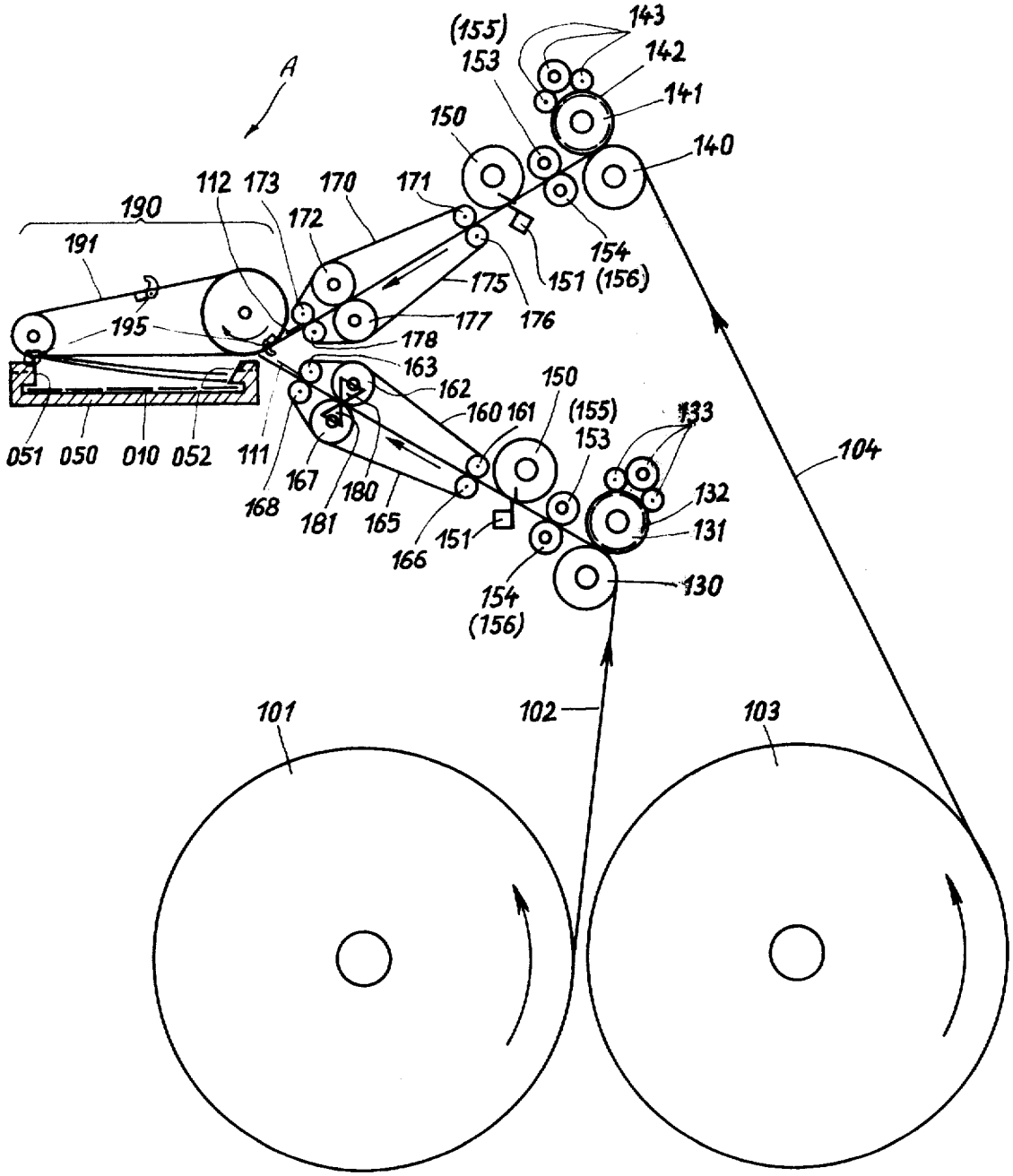
FIG. 4 is a sectional view taken along line 4—4 of FIG. 3.

With reference of FIG. 1, continuously joined bottom form sheets 010 are advanced to a first assembly station A where individual form set sheets 111,112 are supplied in overlying relationship to the bottom sheet 010. The bottom sheet is next advanced to assembly station B where additional individual form set sheets 211,212 are joined to the first assembled form sheets 111,112. The bottom form sheet 010 is advanced in the direction of the illustrated arrows which corresponds to the longitudinal direction of the bottom form sheet 010 for purposes of this description. The advancing motion of the bottom sheet 010 is intermittent and unidirectional in the direction of the arrows, meaning that the bottom sheet 010 is advanced stepwise and is at rest between the stepwise movement. The individual form sheets 111,112,211,212 are joined to the bottom sheet or the previously assembled individual sheets at respective assembly stations while the lower sheet 111,211 of the form sheets is normally provided with a glue line G on opposite surfaces thereof along a top edge, whereby both the sheet 111 and the sheet 112 may be secured to each other and to the bottom sheet when they are joined to the latter in the first assembly station A. The alternate sheet 211 is also provided with a similar glue line G whereby all of the assembled sheets will be secured together when they are joined in their respective assembly stations.

As seen in FIG. 2, the bottom sheet 010 has been processed to provide individual bottom sheets which are intermittently advanced to the assembly stations A and B. The bottom sheets 010 have been provided with indexing and advancing holes 011 along one or two longitudinal edges thereof and further have been transversely provided with fold lines in the form of perforations $P_1$. It will be evident from FIG. 2 that the individual form sheets 111,112,211,212 also have been provided with perforated tear lines $P_2$ extending transversely across the form set. In this instance, it is contemplated that the sheets of the form set shown will be made up from "carbonless" or NCR type transfer paper, and therefore no carbon paper transfer sheets are needed in the form set. However, or any other form of transfer paper alternate sheets such as 111 and 211 could comprise carbon paper sheets in which instance the provision of perforations $P_2$ in the individual form sheets may be selectively altered to meet the requirements of the particular form sets being produced. As can be observed in FIG. 2, the distances S between transverse fold lines $P_1$ comprises a longitudinal extent of each bottom sheet, with the fold line comprising the edgewise juncture between the bottom sheets of each form set.

Obviously, the construction of the form sets may be altered such as, for example, one sheet only could be joined to a respective bottom sheet at each assembly station and, as another example, any number of assembly stations could be utilized to obtain the desired number of individual form sheets in a form set. The preferred embodiment is that illustrated in FIGS. 1 and 2 wherein a pair of individual form sheets are supplied to each assembly station A and B.

It is further contemplated within the scope of this invention that the individual form sheets will be supplied to assembly stations A and B from alternate directions as indicated by the arrows applied to the individual form sheets 112, 212 in FIG. 2. As will be made clearer below, the reason for this alternate supply of individual form sheets to their respective assembly stations is to enable a more compact arrangement of the individual form sheet processing and advancing apparatus, whereby the apparatus may be more closely spaced along the longitudinal direction of the bottom sheet, since the alternate arrangement of apparatus will enable the assembly stations to be located closely together while still enabling adequate room between the individual form sheets processing and advancing apparatus to enable proper inspection and maintenance of the equipment without overcrowding.

Obviously, for purposes of this description, the bottom sheets 010 are shown longer in their longitudinal dimension compared to their transverse dimension, but it should be understood that this is for illustrative purposes only and that it is contemplated as being within the scope of the present invention that the bottom sheets 010 and the individual form set sheets 111,112,211,212 could extend in a longer direction transversely than in the longitudinal direction, or could even be square.

Referring now to FIG. 3, the method and apparatus by which the bottom form sheets 010 are processed and advanced through the assembly stations to receive the individual form sheets thereon will be described. As seen in FIG. 3, continuous, elongated raw web material 002 is supplied from a roll 001 and passes through guide rollers 020 into a bottom sheet processing unit 030. The bottom sheet processing station 030 may include, for example, a hole punch unit comprising punch and anvil members 031,032 which provide indexing and advancing holes 011 (see FIG. 2) along one or more edges of the web material 002. Additional operations may be carried out on the web material 002 to result in the forming of individual bottom sheets 010 continuously joined edgewise along fold lines $P_1$ (see FIG. 2). A tray 033 may be provided to collect the punchings removed from web material 002. A first indexing and advancing means 040 includes means for engaging holes 011 in bottom sheets 010 for advancing said sheets positively and precisely in an intermittent, unidirectional manner into a web or bottom sheet guide 050 which guides the continuously joined bottom sheets 010 through the assembly stations to the second indexing and advancing means 060. The indexing and advancing means 060 operates synchronously with the indexing and advancing means 040 and the bottom sheet processing station 030 and the assembly stations A and B all operate synchronously with the intermittent advancing motion of the bottom form sheets 010. That is to say, certain operations may be applied to the bottom form sheets while they are at rest between intermittent advance movements. This will depend to a certain extent on the nature of the operation to be performed on the bottom sheets. For example, if the bottom sheet processing station 030 included a roller press machine for imprinting bottom sheets 010, such a printing operation would, as is conventional, be carried out while the sheet was in motion. On the other hand, a reciprocating punch and anvil means such as shown at 031,032 would require that the bottom sheet be at rest for accomplishing the hole punching operation. In any event, the individual form sheets are joined to their respective bottom sheets in the assembly stations A and B while the bottom sheet is at rest in its respective assembly station. The continuously joined bottom sheets are advanced to a folding mechanism 070 and thereafter collected in zig-zag relationship in container 080. The folding mechanism 070 folds the bottom sheets along their fold lines $P_1$ in a well known zig-zag manner. Suitable adjusting means are provided in the indexing and advancing means such as 040 and 060 to enable the increments of movement of web material 002 to be varied for obtaining different increments of length between fold lines $P_1$ to thereby alter the longitudinal dimension of the bottom sheets 010 in accordance with desired design criteria of the assembled form sets.

It will be noted from FIG. 2 that preferably, the transverse dimension of the raw material 002 which is processed into the individual bottom sheets 010 is the same as the transverse dimension of the bottom sheet.

It should be clear that the most efficient processing of individual bottom sheets is obtained when the raw web material 002 conforms as closely as possible to the desired end form of the joined bottom sheets 010.

With reference to FIG. 4, there is illustrated a representative arrangement of a form set assembly station A which shows the end view of web guide 050 and the bottom form sheets 010 being advanced therethrough in stepwise manner. The web guide 050 is provided with side edges 051,052, the purpose of which will be described below. For each individual form sheet to be assembled to a bottom sheet, there is provided a continuously advanced length of stock material which may be supplied from a roll. In this instance, individual form sheets 111,112 are provided with their own supply of stock material 102,104 from rolls 101,103, respectively. Preferably, the transverse dimension of stock material 102,104 extending into the paper as viewed in FIG. 4 will correspond to the longitudinal dimension of the individual form sheets as viewed in FIG. 2. A set of rotary printing devices 130,131 and 140,141 is provided for rotary printing with wrap-around letter press forms 132,142 which are supplied by the inking devices 133,143. The printing cylinders 130,131,140,141 are driven continuously with a uniform circumferential speed whereby each rotation of the printing cylinders may imprint a single individual form sheet on said stock material 102,104 as the material passes through the printing process. Feed rolls 153,154 continuously advance the stock material 102 from the press rollers to individual form sheet cutoff means 150,151 which cut individual form sheets to size from stock material 102,104.

The individually cut sheets then travel between conveyor belts 160,165 and 170,175 which accelerate and advance the individual cut sheets to a chain gripper unit 190 which advances the sheets to the assembly station A. The leading edges of the cut individual form sheets 111,112 engage suitable gripper fingers 195 on advancing chain 191 in such a manner that a pair of sheets 111,112 is gripped substantially simultaneously by gripping fingers 195, at which point the sheets are aligned and advanced to the assembly station in overlying, aligned relationship. At a suitable instant, gripper fingers 195 are released in their respective assembly stations to release sheets 111,112 over the web guide 050 and between the edges 051,052.

The inclined edge 052 will serve to guide the free edges of sheets 111,112 onto the bottom sheet 010 and a straight vertical edge 051 of the web guide will insure registration of the sheets 111,112 with the bottom sheet 010. It should be observed that the acceleration of the individual form sheets by means of conveyors 160,165, 170,175 enables the individual form sheets to be periodically advanced to their respective assembly stations and intermittently joined to a bottom sheet while the bottom sheet is at rest, all without requiring any interruption to the feed rate of the stock material 102,104 to certain portions of the individual form sheet processor, i.e., the printer and perforator.

With reference to FIGS. 5 and 6, the processing and advancing of an individual form sheet is shown in greater detail. The stock material 102 is imprinted between rollers 130,131 and fed by driven feed rollers 153, 154 through the cutting means comprising a driven knife drum 150 operating against a counterknife 151. The circumferential speed of the feed rolls 153,154 is equal to that of the cutting drum 150 and the printing cylinders 130, 131, 140 and 141. The leading edge of the stock material 102 constitutes also the leading edge of the individual form sheet 111 after it has been cut from the stock material and this leading edge as shown in FIG. 5 is advanced a predetermined distance between conveyor belts 160,165 prior to the cutoff of the sheet 11 from the stock material 102. The conveyor belts 160,165 pass over driving and guide rollers 161,163,166 and 168. Located between these guide and drive rollers are a pair of idler rollers 162,167 having a nip that is closely spaced whereby conveyor belts 160,165 are urged against each other at the nip with a desired force. On the other hand, rollers 161,166 are spaced apart a suitable amount to enable the leading edge of individual form sheet 111 to be introduced between the belts 160,165 with a minimum amount of advancing force being applied to the sheet 111. As sheet 111 is progressively advanced between the conveyor belts 160,165 by the drive rollers 153,154 prior to the cutoff of the individual sheet 111 from the stock 102, an increasing amount of advancing force is applied to the sheet 111 in a frictional manner, the advancing force progressively increasing as the sheet 111 is fed further between the conveyor belts 160,165. Thus, at the moment of cutoff of sheet 111 from stock material 102 by cutter blade 150, the conveyors 160,165 which have already frictionally engaged at least a portion of sheet 111 proceed to advance a sheet completely through the conveyor and into engagement with gripping fingers 195 on the gripper advance mechanism 190. The rollers 162,161 of course, are suitably spaced from the cutter 150,151 so as to obtain the desired movement of sheet 111 from the cutter to the gripper finger 195. The operation of the printing rollers 130,131, the feed rollers 153,154, the cutter 150,151, the conveyor belts 160,165, and the sheet advancing gripper unit 190 are all synchronized with the advancing movement of the bottom form sheet 010. Moreover, the advancing of sheet 111 by conveyor 160,165 is carried out at an accelerated rate with respect to the input feeding motion of stock material 102 to the cutter blade 150. This enables the stock material 102 to be continuously fed to the cutter 150 at predetermined, continuous rate of motion while the sheets 111, after being cut from the stock material 102, may be rapidly advanced in an accelerated manner to their respective assembly station whereby each sheet may be periodically joined to the bottom sheet 010 while the bottom sheet is at rest, all without interrupting the continuous feed rate of stock material 102 to the cutter 150.

The glue line G (FIG. 1) is selectively applied to appropriate individual form sheets by means of two opposite dispenser jet systems 180, 181 which are controlled by a control system (not illustrated) which could comprise a timing wheel or cam system in combination with an appropriate microswitch and control circuitry. The timing or cam wheel could be driven by a cam shaft driven synchronously, for example, with the drive shaft of the cutter mechanism 150. Such a cam could bear one notch or cam on its periphery so as to actuate a microswitch in synchronism with the advancing movement of a sheet 111 whereby control of the dispensers 180,181 could be achieved to allow the timed flow of glue along the top edge of the sheet 111 on opposite surfaces thereof. The flow of glue, of course, would be interrupted between the passages of individual form sheets between the glue dispensers 180,181. It should be noted that the provision of a differently contoured cam element or a cam driven at some multiple speed with respect to the cutter 150 could provide a dotted line gluing operation in combination with dispensers 180,181. Controllable gluing devices comprising manifold types of timing wheels and microswitches are available, for example, from Messrs. W. Hesselmann, Rosenheim, located in the Federal Republic of Germany. Such devices are readily available to those skilled in the art and the gluing device itself is considered to be conventional for purposes of this description. The glue or adhesive is preferably of the conventional rapid-setting cold adhesive material. The glue supply tank may be arranged higher than the glue dispensers whereby the force of gravity may effect the flow of adhesive to the dispensers, although this is a matter of choice.

FIG. 6 illustrates the arrangement of the feed rollers 153,154 and further illustrates an arrangement for providing tear line perforations $P_2$ (FIG. 2) along the top edge of individual form sheets 111,112,211,212. As seen in FIG. 6, the bearings of the feed rolls are divided into movable parts and fixed parts 157,158, respectively. Spring biasing means 157A, constantly urge the upper rollers 153 into engagement with the lower roller 154. Drive power is supplied via the common gearing 159. The upper rollers are assembled on a shaft 153A and the lower roller 154 is assembled on a shaft 154A. The perforations $P_2$ of the top margins of form sheets 111, etc. may be obtained by means of circular perforation knives at any suitable place where the moving web is fed around a driven guide roll; for example, at cylinder 130, at feed roll 154 or at idler roll 167. The preferred manner of providing perforations $P_2$ is to perform the perforation operation by means of a driven circular perforation knife 155 mounted on shaft 153A of the upper feed roll 153 in FIG. 6. The knife 155 is urged to an axial sense along shaft 153A by means of a spring 155A against a lower counter roll 156, which is provided with a hardened and smooth cutting edge on its peripheral area. The counter roll 156 is mounted as illustrated on lower shaft 154A and cooperates with the upper cutting blades 155 whereby as sheet 111 is fed between the drive rollers 153,154, the top edge of the sheet extends beyond the perforating wheel 155 whereby the perforations $P_2$ may be applied across the sheet 111 as it passes through the drive rollers 153,154

As seen in FIG. 4, an individual form sheet processing means sheet 112 is substantially a duplicate of the processing means for sheet 111 as already described with the exception of the glue dispensing system 180, 181. It should be noted that while bottom sheet 111 was being prepared from stock material 102, upper sheet 112 was simultaneously and synchronously being prepared from material 104 which was lead through the printing rollers 140,141 supplied with ink by means of rollers 143 and thereafter advanced by means of driven rollers 153,154 to the cutter 150,151. An upper conveyor system comprising conveyor belts 170,175 passing over driving and guide rollers 171,173,176, 178 advances the individually cut sheets 112 in an accelerated manner to the gripper fingers 195. Additional idler rollers 172,177 between the conveyors 170,175 function in the same manner as idler rollers 162,167 associated with the lower conveyor belts 160,165.

The individual form sheets advanced by the lower processing unit, after selectively printing, perforating, cutting to size and application of glue lines, are fed from conveyor belts 160,165 into the opened gripper fingers 195 of the chain gripper unit 190 (FIGS. 4 and 5). Here they meet the simultaneously and synchronously prepared form sheets 112 of the upper processing unit. The control of the gripper fingers 195 is performed in a conventional manner by a stationary cam and cam follower arm which actuates the gripper elements. As indicated above, the sheets 111,112 are advanced to the assembly station by means of the gripper fingers 195 in overlying registered relationship. Normally, the absorption of moisture by the glue material from the atmosphere and from the joined sheet material will speed the setting of the glue material and the process of adhering the uncoated sheet 112 and the uncoated bottom sheet 010 with the glue line containing sheet 111. The actual joining process of all the sheets begins when the respective sheets are placed in contact with each other and continues during the further processing and assembling operation while the sheets are in contact with one another.

With reference to FIg. 3, it should be appreciated that the process of unwinding the raw web material 002 from the supply roll 001 and feeding the web to the punching unit 030 may be improved by providing the roll 001 with a separately driven motor (not illustrated)) which is controlled by a conventional web tensioning unit in combination with the advancing and indexing means 040,060. This will stabilize the web tension and unburden the advancing and indexing means, including the guide holes 011 in the bottom sheet 010 during the advancing movement of the bottom sheet 010. Specific technical details of the roller drives, web guiding and tensioning means, punching and printing units are not considered to be a material part of this invention and it is contemplated that such elements may be conventional parts obtainable in the trade.

If required, the odd number of individual form sheets per set can be processed without altering the general construction of the apparatus. To carry this out, at one assembly station, one of the individual form sheet processing units preferably the upper sheet unit will not be supplied with paper and its respective gluing dispenser 180,181 will be closed. The one processed individual form sheet will thereby replace a pair of individual form sheets at its respective position in the assembled form set.

If for some reason individual form sheets have been prepared externally of the apparatus of this invention, for example, when it is desired to process partially carbon coated sheets, the present system can be modified by replacing the stock material supplies 102,104 with individual sheet stacks and sheet feeding means which may stepwise feed individual sheets into the printing devices 130,131 and 140,141. Operating thusly, the corresponding rotary transverse cutters 150,151 may be utilized to provide additional alignment of the individual sheets by (not illustrated) replacing the lower knives with slotted metal sheets which serve as a guide for the individual form sheets, and the rotary upper knives may be replaced by metal rake sheets which slightly dip into the slots. This modifies the transverse cutters into rotary alignment stops which improves alignment of the individual sheets when they are forerunning a small amount, in a similar manner as when individual sheets are severed from stock material 102,104. The preferred manner of using the present invention will be feeding the assembly stations from continuous stock material 102,104, since this naturally precludes the occurrence of a failure of the sheet feeding means or the inadvertent feeding of double sheets to the processor. It also eliminates the necessity for utilizing expensive appliance for detecting malfunctions in the sheet feeding system.

I claim:

1. A method for making continuous, linearly attached form sets including individual form sheets attached in overlying relationship to a continuous bottom form sheet at spaced intervals along the length of the bottom form sheet, the method comprising:

supplying and advancing a continuous, elongated raw web material to a bottom form sheet processing station with intermittent unidirectional movement, the web material being advanced through said processing station by indexing and advancing means through suitable increments of length corresponding to the desired lengthwise dimension of an individual form set, and being at rest between each intermittent movement;

processing said raw web material to form continuous, joined bottom form sheets, said processing operation being carried out synchronously with said raw web material advancing movement;

advancing said bottom form sheets contemporaneously with said raw web material advancing movement from said processing station sequentially to and through at least a pair of form set assembly stations;

supplying registered overlying pairs of individual form sheets periodically to each of said form set assembly stations;

assembling a first of said pair of individual form set sheets in overlying relationship with said bottom form sheets at a first assembly station while said bottom sheet is at rest at said first assembly station;

assembling a second of said pairs of individual form set sheets in overlying relationship with said first pair of individual form set sheets at a second assembly station while said bottom sheet is at rest at said second assembly station;

securing said assembled pairs of individual form set sheets to each other and to said bottom sheet to form continuous form sets linearly secured to each other through said joined bottom form sheets.

2. The process recited in claim 1 further including applying glue lines to the lowermost sheet of each pair of individual form sheets supplied to said assembly stations along both surfaces of one edge area of each lowermost sheet prior to supplying said lowermost sheet to its respective assembly station, whereby attachment of the individual form sheets to the bottom sheets and to each other will be effected along glue lines on said lowermost sheets.

3. The process recited in claim 1 further including the steps of processing each sheet of said overlying pairs of individual form sheets from individual, continuous stock supplies, the processing of each individual form sheet including at least cutting said individual sheets to size from said continuous stock supplies and applying a glue line to appropriate individual form sheets prior to advancing said individual form sheets to said assembly stations; and registering a pair of individual form sheets in overlying relationship while advancing said sheets to their respective assembly stations.

4. The process recited in claim 3 further including, during the processing of said individual form sheets, the step of linearly accelerating each individual form sheet after it has been cut to size from its stock supply in the direction of its advancement towards its respective form set assembly station, whereby the processing operations performed on each individual form sheet prior to its being cut to size may be carried out uninterruptedly at a desired continuous rate of motion of said supply stock, while said individual form sheet is periodically advanced to its respective assembly station in synchronism with the intermittent advancing motion of said continuous bottom form sheet.

5. The process recited in claim 4 further including supplying said assembly stations with said pairs of individual form sheets in opposite, transverse directions with respect to the longitudinal dimension of said joined bottom sheets, whereby the processing apparatus for said individual form sheets may be located on opposite sides of said bottom form sheets at each of said assembly stations.

6. A method for making continuous, linearly attached form sets including individual form sheets attached in overlying relationship to a continuous bottom form sheet at spaced intervals along the length of the bottom form sheet, the method comprising:

supplying and advancing a continuous, elongated raw web material to a bottom form sheet processing station with intermittent unidirectional movement, the web material being advanced through said processing station by indexing and advancing means through suitable increments of length corresponding to the desired lengthwise dimension of an individual form set, and being at rest between each intermittent movement;

processing said raw web material to form continuous, joined bottom form sheets, the processing operation being carried out synchronously with said raw web material advancing movement;

advancing said bottom form sheets contemporaneously with said raw web material advancing movement from said processing station sequentially to and through a pair of form set assembly stations;

supplying a single individual form set sheet periodically to the first of said pair of form set assembly stations and registered overlying pairs of individual form set sheets periodically to the second of said pair of form set assembly stations;

assembling said single individual form set sheet in overlying relationship with said bottom form sheets at the first of said pair of assembly stations while said bottom sheet is at rest at the first assembly station;

assembling said pairs of individual form set sheets in overlying relationship with said first individual form set sheet at the second of said pair of assembly stations while said bottom sheet is at rest at said second assembly station; and securing said individual form set sheets to each other and to said bottom sheet to form continuous form sets linearly secured to each other through said joined bottom form sheets.

7. Apparatus for making continuous, linearly attached form sets comprising edgewise joined bottom form sheets having overlying individual form sheets attached thereto, the apparatus comprising:

means for supplying a continuous, elongated raw web material;

means for advancing said web material with intermittent, unidirectional movement through suitable increments of length corresponding to a desired longitudinal dimension of an individual form set;

means for processing continuously edgewise joined bottom form sheets from said advanced web material synchronously with said web advancement motion;

at least a first form set assembly station, and means for advancing each of said joined bottom sheets from said bottom sheet processing means sequentially to said first assembly station synchronously with the said processing of said bottom sheets;

means for processing and periodically supplying at least first individual form sheets to said first assembly station, said assembly station including means for aligning an individual first form sheet with each of said bottom sheets in overlying registration, with each first individual form sheet being joined to its respective bottom sheet at said assembly station in registered, overlying relationship while said bottom sheet is at rest between advancing motions; each joined individual sheet and bottom sheet comprising at least a portion of a form set;

at least one additional form set assembly station;

means for advancing said form set portions from said first assembly station to said additional assembly station synchronously with said advancing motion of said bottom sheets;

means for processing and periodically supplying successive individual form sheets to said additional assembly station, said additional assembly station including means for aligning each of said second successive form sheets with a first individual form sheet in overlying relationship on a bottom sheet, each of said successive form sheets being joined to a first individual form sheet in said additional assembly station while its respective underlying bottom sheet and first form sheet are at rest between advancing motions; and means for advancing said assembled form set portions from said second assembly station synchronously with the said advancing motion of said bottom sheets.

8. Apparatus for making continuous, linearly attached form sets comprising edgewise joined bottom form sheets having overlying individual form sheets attached thereto, the apparatus comprising:

means for supplying a continuous, elongated raw web material;

means for advancing said web material with intermittent, unidirectional movement through suitable increments of length corresponding to a desired longitudinal dimension of an individual form set;

means for processing continuously edgewise joined bottom form sheets from said advanced web material synchronously with said web advancement motion;

at least a first form set assembly station and means for advancing each of said joined bottom sheets from said bottom sheet processing means sequentially to said first assembly station synchronously with the said processing of said bottom sheets;

means for processing and periodically supplying first groups of individual form sheets to said first assembly station in synchronism with said bottom sheet advancing motion, said assembly station including means for aligning said individual form sheets in said first groups with each other and with one of said bottom sheets, all in overlying relationship with respect to each other; the individual form sheets in each group being secured to each other and each group of individual form sheets being secured to a respective bottom sheet in overlying relationship while said bottom sheet is at rest between advancing motions to make at least a first assembled form set portion;

at least one additional form set assembly station;

means for advancing said first assembled form set portions from said first assembly station to each additional assembly station synchronously with said advancing motion of said bottom sheets;

means for processing and periodically supplying successive groups of individual form sheets to each additional assembly station synchronously with the advancement of first assembled form set portion;

means for aligning the individual form sheets in each of said successive groups with each other and with a previously assembled form set portion in overlying relationship, each successive group of individual form sheets being joined to an underlying group of form sheets at each individual form set assembly station; and means for advancing said bottom sheet and joined individual form sheets from said additional assembly station synchronously with the said advancing motion of said bottom sheets.

9. Apparatus for making continuous, linearly attached form sets as recited in claim 8, further wherein there are an even number of individual form sheets in each of said first and successive groups, the individual form sheet next adjacent to the bottom sheet being provided with glue lines on opposite surfaces thereof to secure said adjacent individual form sheets to said bottom sheet and the next overlying individual form sheet in said first assembly station; and each alternate individual form sheet also being provided with glue lines on opposite surfaces thereof to secure the individual form sheets of each group to each other.

10. Apparatus for making continuous, linearly attached form sets as recited in claim 8, further wherein each of said individual form sheet processing and advancing means is located on alternate sides of the longitudinal axis of said joined bottom form sheets at each of said assembly stations.

11. Apparatus for making continuous, linearly attached form sets as recited in claim 8, further wherein said means for processing each of said first and successive groups of individual form sheets includes at each assembly station individual form sheet continuous stock material supplies equivalent in number to the number of individual form sheets in each of said groups, and further including means for cutting to size each individual form sheet from its respective continuous stock material prior to the said supply of each of said individual form sheets to its respective assembly station.

12. A process for making continuous linearly attached form sets including individual form sheets attached in overlying relationship to a continuous bottom form sheet at spaced intervals along the length of the bottom form sheet, the process comprising:

supplying and advancing a continuous, elongated, raw web material through a bottom form sheet processing station with intermittent unidirectional movement, the web material being advanced through said processing station by indexing and advancing means through suitable increments of length corresponding to the desired lengthwise dimension of an individual form set, and being at rest between each intermittent movement;

processing said raw web material to form continuous, joined bottom form sheets, the processing operation being carried out synchronously with said raw web material advancing movement;

advancing said bottom sheets synchronously with said raw web material advancing movement from said processing station to and through at least a first form set assembly station;

supplying first individual form sheets periodically to said first form set assembly station and securing said individual first form sheets to said bottom sheets in overlying relationship at said assembly station;

sequentially advancing said bottom form sheets through at least a second form set assembly station;

periodically supplying individual succeeding form sheets to said second form set assembly station;

assemblying at least one succeeding individual form sheet in overlying relationship with said first individual form sheet at said second assembly station, including joining said succeeding individual form sheet to said first individual form sheet;

each form set assembly operation being carried out while said bottom sheet is at rest; whereby said individual form sheets are joined to said bottom form sheets as said bottom sheets are intermittently advanced through said assembly stations, the combination of individual overlying form sheets and an underlying bottom form sheet forming at least a portion of an individual form set, each individual form set being linearly attached to an adjacent form set through said joined bottom form sheets.

* * * * *